US008511587B2

(12) United States Patent
Miller et al.

(10) Patent No.: US 8,511,587 B2
(45) Date of Patent: Aug. 20, 2013

(54) SHOWERHEAD ASSEMBLY

(75) Inventors: Michael Miller, Portage, MI (US); James Wu, Taichung Hsien (TW); Alex Wu, Taichung Hsien (TW); Edgar Alexander Zarins, Ann Arbor, MI (US)

(73) Assignee: Masco Corporation of Indiana, Indianapolis, IN (US)

( * ) Notice: Subject to any disclaimer, the term of this patent is extended or adjusted under 35 U.S.C. 154(b) by 317 days.

(21) Appl. No.: 13/005,585

(22) Filed: Jan. 13, 2011

(65) Prior Publication Data

US 2012/0181356 A1 Jul. 19, 2012

(51) Int. Cl.
*B05B 1/18* (2006.01)
*B05B 1/12* (2006.01)
*B05B 1/00* (2006.01)

(52) U.S. Cl.
USPC ..... 239/548; 239/596; 239/600

(58) Field of Classification Search
USPC ..... 239/428.5, 447–449, 548, 554–559, 239/567, 587.1–587.4, 589, 596, 600
See application file for complete search history.

(56) References Cited

U.S. PATENT DOCUMENTS 1,830,694 A * 11/1931 Fraser ..... 239/460
1,982,538 A * 11/1934 Reedy ..... 239/117
2,448,792 A * 9/1948 Fraser ..... 239/460
2,657,955 A * 11/1953 Manning ..... 239/458
2,790,677 A * 4/1957 Filliung et al. ..... 239/109
2,968,443 A * 1/1961 Manning ..... 239/460
3,013,729 A * 12/1961 McLean ..... 239/109
3,065,917 A * 11/1962 Fraser ..... 239/460
3,967,783 A 7/1976 Halsted et al.
4,629,124 A * 12/1986 Gruber ..... 239/428.5
5,918,811 A * 7/1999 Denham et al. ..... 239/123
6,378,790 B1 4/2002 Paterson et al.
2005/0284967 A1* 12/2005 Korb et al. ..... 239/552
2006/0157590 A1* 7/2006 Clearman et al. ..... 239/383
2011/0000983 A1* 1/2011 Chang ..... 239/567
2011/0139904 A1* 6/2011 Xu et al. ..... 239/548

* cited by examiner

*Primary Examiner* — Darren W Gorman
(74) *Attorney, Agent, or Firm* — Carlson, Gaskey & Olds, PC

(57) ABSTRACT

A shower head has a nozzle, a shell, a water inlet, and an assembly for holding the nozzle. The assembly has an upper plate made of a first plastic material and has a first opening having a first diameter through which the nozzle extends, a lower plate made of a second plastic material and has a second opening through which the nozzle extends, and an elastomeric middle plate has a third opening having a third diameter that is smaller than the first or second diameter through which the nozzle extends and is in contact therewith. The first material and the second material are ultrasonically welded together to trap the middle plate therebetween and the first opening, the second opening and the third opening are roughly coaxial with each other.

19 Claims, 4 Drawing Sheets

SHOWERHEAD ASSEMBLY

BACKGROUND OF THE INVENTION

Some shower heads have a faceplate that includes a plastic substrate having a plurality of circumferential openings disposed about a central opening provided therein. The faceplate typically has a plurality of nozzles that protrude through the circumferential openings. Water flows around the nozzles in varying patterns caused by moving the nozzles, usually in unison, into and out of the faceplate. Typically, the nozzles are supported by a spider that is manipulated by a user to move the nozzle bodies into and out of the faceplate.

In some prior art embodiments an o-ring or a thermoplastic rubber layer formed on walls of the face plate circumferential openings provide a seal so that water flows through grooves in the nozzle bodies.

SUMMARY OF THE INVENTION

According to an exemplar disclosed herein, a shower head has a nozzle, a shell, a water inlet, and an assembly for holding the nozzle. The assembly has an upper plate made of a first plastic material and has a first opening having a first diameter through which the nozzle extends, a lower plate made of a second plastic material and has a second opening through which the nozzle extends, and an elastomeric middle plate has a third opening having a third diameter that is smaller than the first or second diameter through which the nozzle extends and is in contact therewith. The first material and the second material are ultrasonically welded together to trap the middle plate therebetween and the first opening, the second opening and the third opening are roughly coaxial with each other.

According to a further exemplar disclosed herein, a shower head has a nozzle, and an assembly for holding the nozzle. The assembly has an upper plate made of a first plastic material and has a first opening having a first diameter through which the nozzle extends, a lower plate made of a second plastic material and has a second opening through which the nozzle extends, and an elastomeric middle plate has a third opening having a third diameter that is smaller than the first or second diameter through which the nozzle extends and is in contact therewith. The first material and the second material are ultrasonically welded together to trap the middle plate therebetween and the first opening, the second opening and the third opening are roughly coaxial with each other.

According to a further exemplar disclosed herein an assembly for a shower head has an upper plate made of a first plastic material and has a first opening having a first diameter through which the nozzle extends, a lower plate made of a second plastic material and has a second opening through which the nozzle extends, and an elastomeric middle plate has a third opening having a third diameter that is smaller than the first or second diameter through which the nozzle extends and is in contact therewith. The first material and the second material are ultrasonically welded together to trap the middle plate therebetween and the first opening, the second opening and the third opening are roughly coaxial with each other.

These and other features of the present invention can be best understood from the following specification and drawings, the following of which is a brief description.

DETAILED DESCRIPTION OF THE PREFERRED EMBODIMENT

Figure 1:
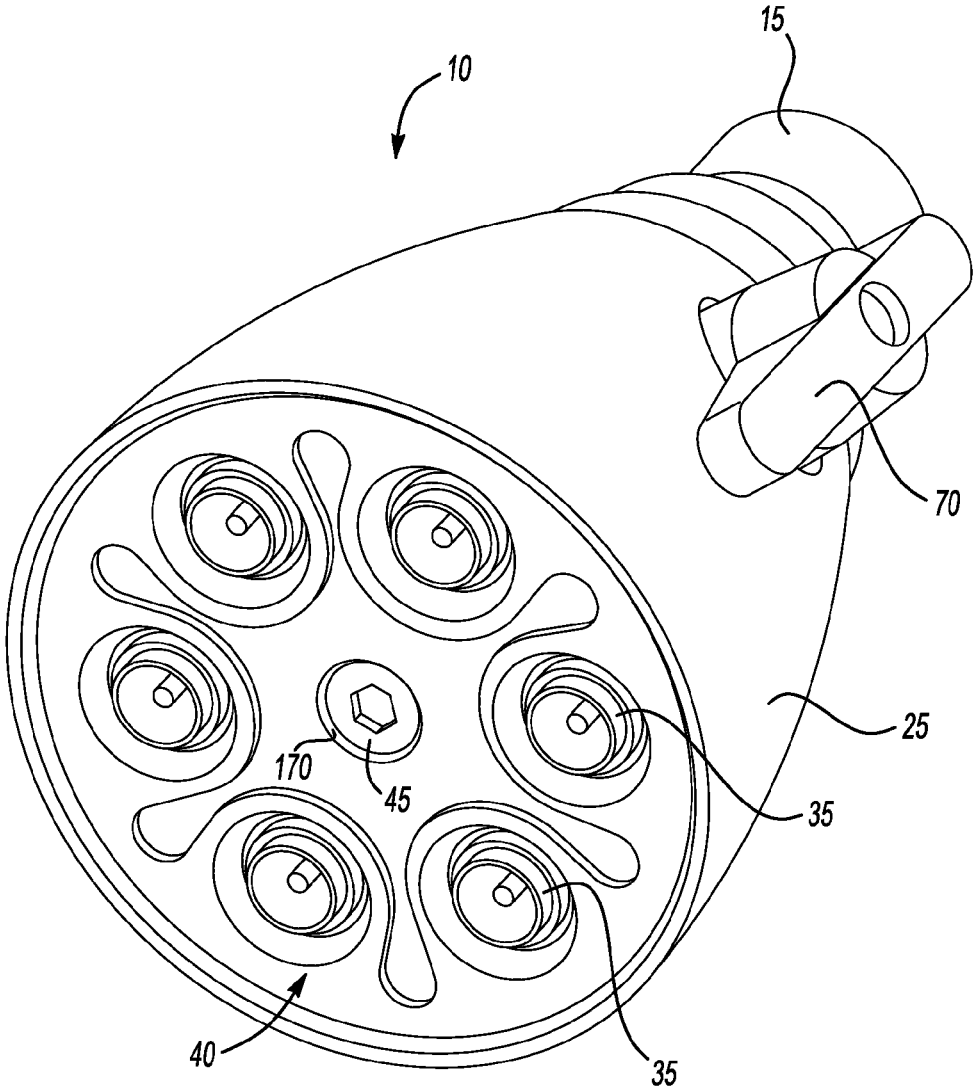
FIG. 1 is a cross-sectional view of a showerhead incorporating an embodiment of the invention.
Figure 2:
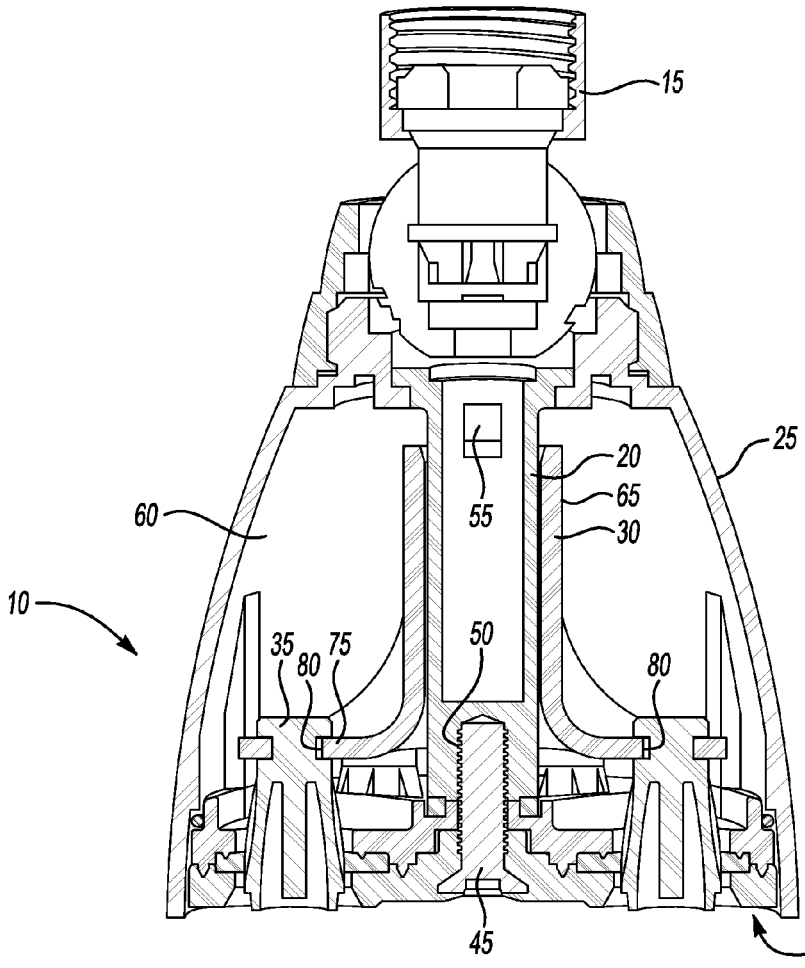
FIG. 2 is a cross-sectional view of the showerhead of FIG. 1.

Referring now to FIGS. 1 and 2, a shower head 10 includes a water inlet 15, a central column 20 for receiving water, a shell 25, a spider 30, a plurality of nozzles 35, and a sealing system 40. The sealing system 40 is disposed within the shell 25 by attaching a screw 45 into a threaded axial opening 50 in the central column 20. The support column has an opening 55 that allows water to flow into the area 60 between the central column 20 and the shell 25 for expulsion from the nozzles 35.

The spider 30 includes a central cylinder 65 disposed closely around the central column 20. The central cylinder 65 is manipulated by handle 70 by a connection (not shown) to slide along the central column 20. The spider 30 has a flange 75 that extends normal to the central cylinder 65, the flange 75 having a plurality openings 80 each opening 80 holding a nozzle 35. As the spider 30 is manipulated upwardly and downwardly, each nozzle 30 is moved within the sealing system 40, as will be discussed infra, to vary spray patterns to a user in the shower (not shown).

Figure 2A:
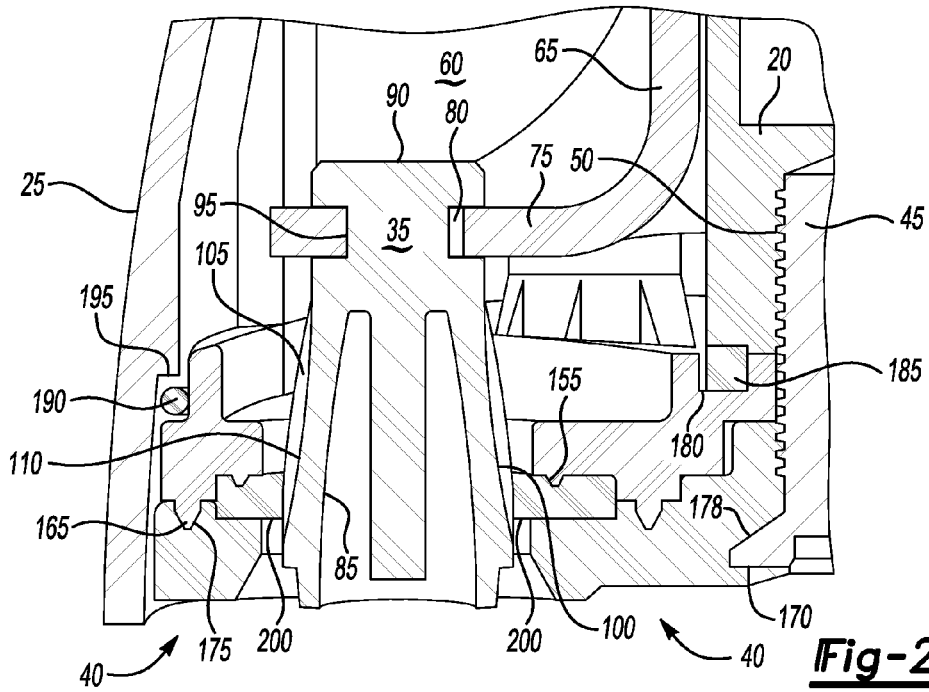
FIG. 2*a* is a close up view of a portion of the showerhead of FIG. 2 taken along the line 2-2.

Referring now to FIG. 2A, each nozzle 35 has a body 85, a head 90, and a neck 95 connecting the head 90 and the body 85, the neck 95 fitting within openings 80 within the flange 75. The head 90 traps each nozzle 35 within the opening 80 so that translation of the spider 30 moves the nozzle 35 with the spider 30. Each nozzle 35 has a plurality of grooves 100 of varying shapes. For example, a top portion 105 of the groove 100 is narrower to provide a fine spray, a middle portion 110 of the groove is thicker to provide a coarser spray etc. One of ordinary skill will recognize that other groove shapes that vary spray patterns are contemplated herein.

Figure 3:
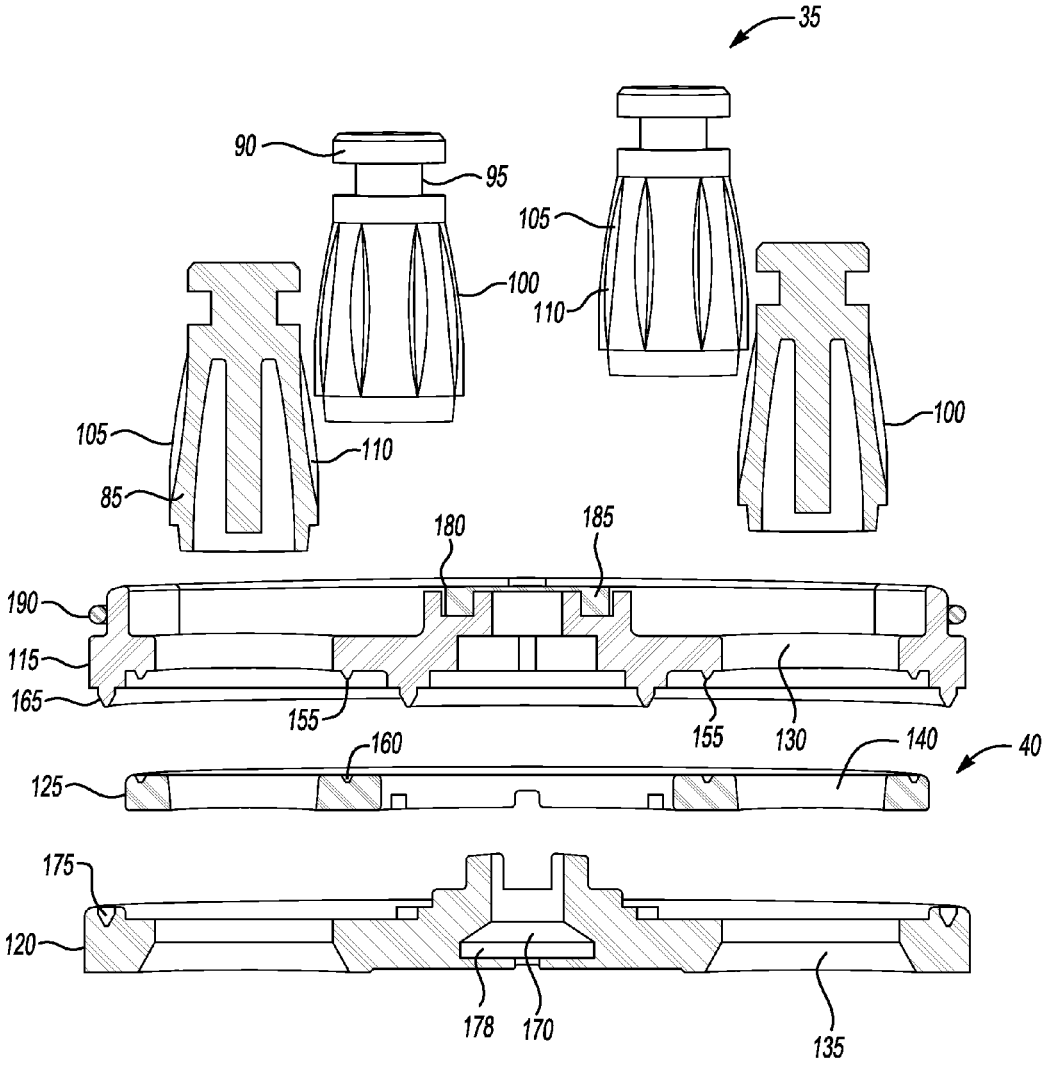
FIG. 3 is an exploded view of the seal of FIG. 2.
Figure 4:
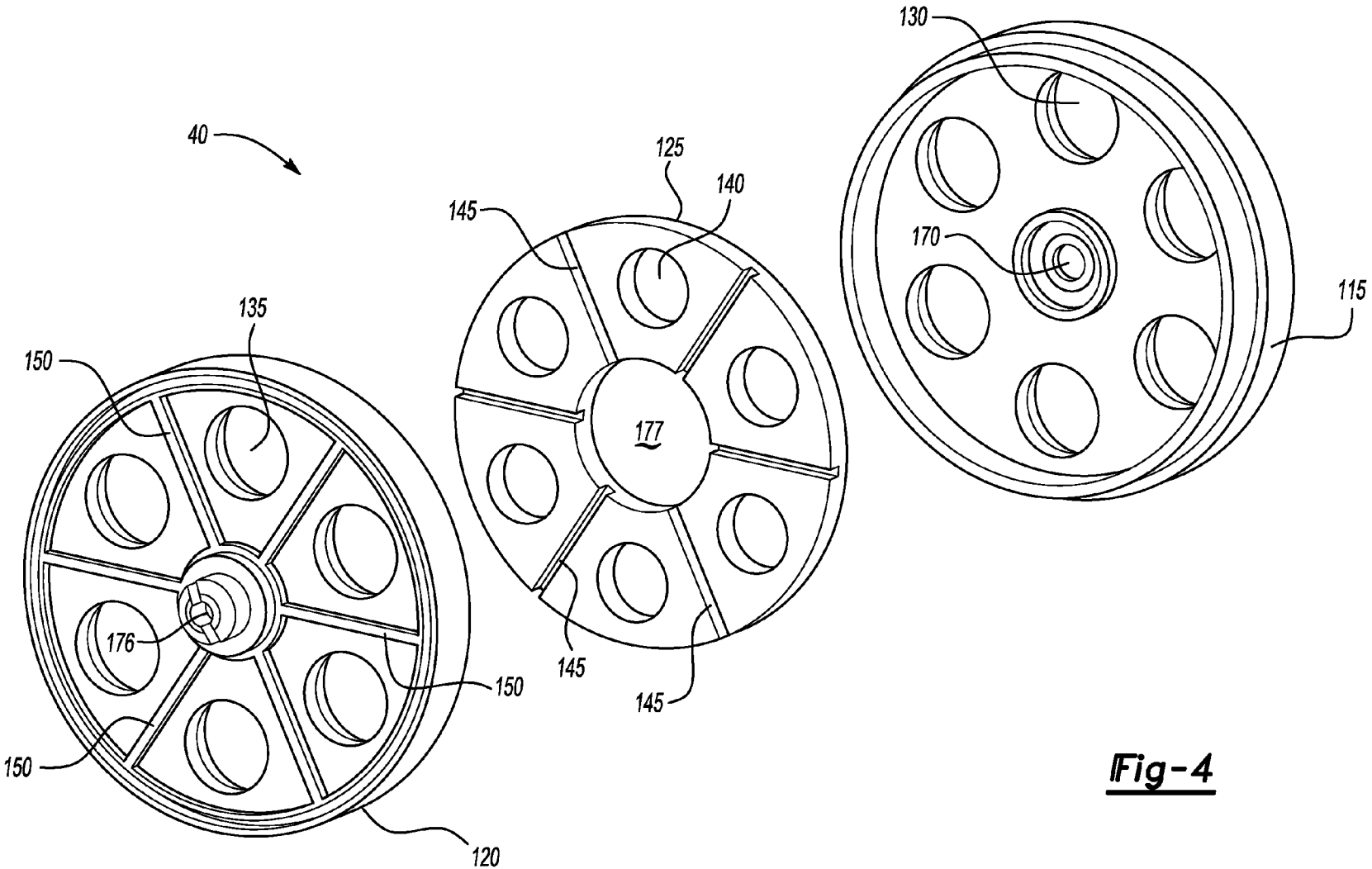
FIG. 4 is an exploded, perspective view of the seal of FIG. 3.

Referring now to FIGS. 2A, 3 and 4, the sealing system 40 is comprised of three disks, an upper disk 115 made of a plastic material, a lower disk 120 also made of a plastic material, and a middle disk 125 made of a rubber or an elastomeric material disposed therebetween. The upper disk 115 has six openings 130, each opening receiving a nozzle 35 therein. The lower disk 120 has six openings 135, each opening receiving a nozzle 35 therein and the middle disk 125 has six openings 140, each opening receiving a nozzle 35 therein. The upper disk openings 130 and the lower disk openings 135 are larger than the middle disk openings 140 since upper disk openings 130 and the lower disk openings 135 do not contact the nozzle bodies. The middle disk openings 140 contact the nozzles 35.

The upper and lower disks 115, 120 may be made of polymers that are ultrasonically weldable such as ABS, Acrylic, Polycarbonate or PVC.

Each of the disks 115, 120 and 125 are aligned roughly coaxially as will be discussed herein to ensure that the openings 130, 135, 140 are aligned roughly coaxially for assembly and use. For instance, the middle disk has six grooves 145 extending radially therein that that mate with the six protrusions 150 in the lower disk 120. Similarly, the upper disk 115 has a first bead 155 (see FIG. 3) about each opening 130 that mates with a groove 160 about each opening 140 in the middle disk 125 so that the upper disk does not rotate relative to the other disks 120, 125 during assembly and operation.

The upper disk 115 also has a second bead 165 that functions as a weld bead that extends around a central opening 170 and the openings 130 therein. The lower disk 120 has a second groove 175 for receiving that second bead 165 so that during ultrasonic welding, the parts merge together and form a chemical bond and a central opening 176. The upper disk 115 has a circumferential groove 180 therein for receiving a square shaped o-ring 185 to abut and seal about the axial opening 50 if the sealing system 40 is attached to the central column 20. The middle disk has a central opening 177. Central opening 170 has a cavity 178 for receiving the screw 45.

To assemble the part, the middle disk 125 is aligned as stated hereinabove and sandwiched between the upper and lower disks 115 and 120 that are then ultrasonically welded together to trap the middle disk 125 therebetween. The sealing system 40 is then held in the central column by screw 45 in the shell 25. O-ring 190 is trapped by a shoulder 195 on the shell to seal the area 60. The square shaped o-ring 185 provides a seal against the central column 20 and the sealing assembly at the center thereof. The use of rubber in the middle disk 125 helps control dimensions around each nozzle 35 and improves spray performance thereby. The openings 130, 140 and 150 are roughly coaxial with the openings 130 and 150 having a greater diameter than the opening 140. As a result, portions 200 of the middle plate 125 cantilever above opening 135 and below opening 130 and contact the nozzle 35 while the upper disk 115 and the lower disk 120 may not contact the nozzle 35.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A shower head comprising;
at least one nozzle,
a shell disposed about said nozzle, and
an assembly for holding the nozzle the assembly having,
an upper plate made of a first material and having a first opening defined by a first diameter through which the nozzle extends,
a lower plate made of a second material and having a second opening defined by a second diameter through which the nozzle extends,
an elastomeric middle plate having a third opening defined by a third diameter that is smaller than the first or second diameter through which the nozzle extends and is in contact therewith, and
wherein the first material and the second material are joined together to trap the middle plate therebetween and wherein the first opening, the second opening, and the third opening are roughly coaxial with each other.

2. The shower head of claim 1 wherein the upper plate is connected to the middle plate and the upper plate is connected to the lower plate so that each of the upper plate, the middle plate and the lower plate is not rotatable relative to another of the upper plate, the middle plate, or the lower plate.

3. The shower head of claim 1 wherein the lower plate has an opening holding an attachment attaching to a central column.

4. The shower head of claim 3 wherein the attachment is a screw.

5. The shower head of claim 1 further comprising a seal disposed around the assembly sealing the assembly within the shell.

6. The shower head of claim 5 wherein the seal is an o-ring.

7. The shower head of claim 1 wherein the first material and the second material are ultrasonically welded together.

8. A shower head comprising;
at least one nozzle, and
an assembly for holding the nozzle the assembly having
an upper plate made of a first material and having a first opening defined by a first diameter through which the nozzle extends,
a lower plate made of a second material and having a second opening defined by a second diameter through which the nozzle extends,
an elastomeric middle plate having a third opening defined by a third diameter that is smaller than the first or second diameter through which the nozzle extends and is in contact therewith, and
wherein the first material and the second material are joined together to trap the middle plate therebetween, and wherein the first opening, the second opening, and the third opening are roughly coaxial with each other.

9. The shower head of claim 8 wherein the upper plate is connected to the middle plate and the upper plate is connected to the lower plate so that each of the upper plate, the middle plate, and the lower plate is not rotatable relative to another of the upper plate, the middle plate or the lower plate.

10. The shower head of claim 8 wherein the lower plate has an opening holding an attachment for attaching the assembly to the shower head.

11. The shower head of claim 10 wherein the attachment is a screw.

12. The shower head of claim 8 further comprising a seal disposed around the assembly for sealing the assembly with a shell.

13. The shower head of claim 12 wherein the seal is an o-ring.

14. The shower head of claim 8 wherein the first material and the second material are ultrasonically welded together.

15. The shower head of claim 8 wherein the first material and the second material are plastic.

16. An assembly for a shower head;
an upper plate made of a first plastic material and having a first opening defined by a first diameter,
a lower plate made of a second plastic material and having a second opening defined by a second diameter,
an elastomeric middle plate having a third opening defined by a third diameter that is smaller than the first or second diameter, wherein the first material and the second material are ultrasonically welded together to trap the middle plate therebetween, and wherein the first opening, the second opening, and the third opening are roughly coaxial with each other.

17. The sealing assembly of claim 16 wherein the upper plate is connected to the middle plate and the upper plate is connected to the lower plate so that each of the upper plate, the middle plate, and the lower plate is not rotatable relative to another of the upper plate, the middle plate or the lower plate.

18. The sealing assembly of claim 16 wherein the lower plate has an opening for holding an attachment for attaching the assembly to the shower head.

19. The sealing assembly of claim 18 wherein the attachment is a screw.

* * * * *